United States Patent [19]

Gormel

[11] Patent Number: 4,859,574

[45] Date of Patent: Aug. 22, 1989

[54] PROCESS FOR STABILIZING PHOTOGRAPHIC ELEMENTS USING A SOLUTION COMPRISING A WATER-SOLUBLE N-METHYLOL COMPOUND AND A BUFFERING AGENT

[75] Inventor: Thomas M. Gormel, Spencerport, N.Y.

[73] Assignee: Eastman Kodak Company, Rochester, N.Y.

[21] Appl. No.: 169,249

[22] Filed: Mar. 15, 1988

[51] Int. Cl.[4] ..... G03C 7/40; G03C 5/39

[52] U.S. Cl. ..... 430/372; 430/427; 430/428; 430/429; 430/463; 430/490

[58] Field of Search ..... 430/372, 427, 428, 429, 430/463, 490

[56] References Cited

U.S. PATENT DOCUMENTS

| | | | |
|---|---|---|---|
| 2,487,446 | 3/1949 | Kellog | 95/88 |
| 2,579,435 | 7/1951 | Mackey | 95/88 |
| 3,201,244 | 10/1965 | Larson | 96/56 |
| 3,473,929 | 12/1969 | Jeffreys et al. | 96/56 |
| 3,801,322 | 4/1974 | Shirasu et al. | 430/372 |
| 3,879,202 | 4/1975 | Yamaguchi | 430/372 |
| 4,623,613 | 11/1986 | Ishikawa et al. | 430/428 |

*Primary Examiner*—Paul R. Michl
*Assistant Examiner*—Patrick A. Doody
*Attorney, Agent, or Firm*—Alfred P. Lorenzo

[57] ABSTRACT

A process for stabilizing the magenta dye image in a photographic color element comprises the steps of contacting the element with an aqueous stabilizing solution containing a water-soluble N-methylol compound and an alkaline buffering agent, subjecting the stabilized element to an aqueous wash to remove scum formed by the treatment with the stabilizing solution, and drying the element at an elevated temperature.

10 Claims, 3 Drawing Sheets

PROCESS FOR STABILIZING PHOTOGRAPHIC ELEMENTS USING A SOLUTION COMPRISING A WATER-SOLUBLE N-METHYLOL COMPOUND AND A BUFFERING AGENT

FIELD OF THE INVENTION

This invention relates in general to color photography and in particular to methods and compositions for use in the processing of color photographic elements. More specifically, this invention relates to a novel stabilization process which is useful in photographic color processing to provide enhanced magenta dye stability.

BACKGROUND OF THE INVENTION

Multicolor, multilayer photographic elements are well known in the art of color photography. Usually, these photographic elements have three different selectively sensitized silver halide emulsion layers coated on one side of a single support. The vehicle used for these emulsion layers is normally a hydrophilic colloid, such as gelatin. One emulsion layer is blue-sensitive, another green-sensitive and another red-sensitive. Although these layers can be arranged on a support in any order, they are most commonly arranged with the support coated in succession with the red-sensitive layer, the green-sensitive layer and the blue-sensitive layer (advantageously with a bleachable blue-light-absorbing filter layer between the blue-sensitive layer and the green-sensitive layer) or with the opposite arrangement and no filter layer. Colored photographic images are formed from latent images in the silver halide emulsion layers during color development by the coupling of oxidized aromatic primary amine color developing agent with couplers present either in the color developer solution or incorporated in the appropriate light-sensitive layers. Color photographic elements containing dye images usually utilize a phenolic or naphtholic coupler that forms a cyan dye in the red-sensitive emulsion layer, a pyrazolone or cyanoacetyl derivative coupler that forms a magenta dye in the green-sensitive emulsion layer and an acetylamide coupler that forms a yellow dye in the blue-sensitive emulsion layer. Diffusible couplers are used in color developer solutions. Non-diffusing couplers are incorporated in photographic emulsion layers. When the dye image formed is to be used in situ, couplers are seleced which form non-diffusing dyes. For image transfer color processes, couplers are used which will produce diffusible dyes capable of being mordanted or fixed in the receiving sheet.

It is well known in the photographic art to utilize a stabilizing bath as the final step in the processing of both color films and color papers. Such baths can serve to reduce stain and/or enhance dye stability. A wide variety of different stabilizing compositions have been proposed for such use. Thus, the known stabilizing baths include those containing thiourea or a substituted thiourea as described in Kellog, U.S. Pat. No. 2,487,446 issued Nov. 8, 1949; aliphatic aldehydes as described in Harsh et al, U.S. Pat. No. 2,518,686 issued Aug. 15, 1950; addition products of formaldehyde and a urea, as described in Mackey, U.S. Pat. No. 2,579,435 issued Dec. 18, 1951; tetramethylol cyclic alcohols or ketones as described in Clarke et al, U.S. Pat. No. 2,983,607 issued May 9, 1961; glucoheptonates as described in Bard, U.S. Pat. No. 3,157,504 issued Nov. 17, 1964; carbohydrazides as described in Larson, U.S. Pat. No. 3,201,244, issued Aug. 17, 1965; amino acids as described in Jeffreys, U.S. Pat. No. 3,291,606 issued Dec. 13, 1966; mixtures of an aldehyde and an alkoxy substituted polyoxyethylene compound as described in Seemann et al, U.S. Pat. No. 3,369,896 issued Feb. 20, 1968; compounds comprising a tri(hydroxymethyl)methyl group as described in Jeffreys et al, U.S. Pat. No. 3,473,929 issued Oct. 21, 1969; and addition complexes of an alkali metal bisulfite and an aldehyde as described in Mowrey, U.S. Pat. No. 3,676,136 issued July 11, 1972. The use of more than one active agent in such stabilizing baths is also known. For example, U.S. Pat. No. 3,676,136 to Mowray describes the use of antioxidants such as glucose, galactose, sorbitol or mannitol in a stabilizing bath in addition to an aldehyde bisulfite addition complex.

Magenta dye stability is a particularly serious problem in color photography, as the magenta dye image tends to fade much more rapidly than either the cyan dye image or the yellow dye image. The darkkeeping stability of magenta image dyes derived from pyrazolone couplers is adversely affected by the presence of the coupler itself. This is particularly evident in the toe and midscale regions of the green sensitometric curve. In these areas, there is a substantial amount of the unreacted coupler. This unreacted coupler undergoes complex chemical reactions with the magenta dye.

For many years, formaldehyde has been commonly used as a stabilizing agent in photographic color processing to provide enhanced magenta dye stability. The photographic element is treated with a final bath containing formaldehyde, and the magenta-dye-forming coupler and the formaldehyde react to form a compound that does not cause dye fade. Under normal processing conditions, this reaction takes place in the drying oven. However, while formaldehyde is a very effective stabilizing agent for this purpose, its use is highly disavantageous from an ecological standpoint because of the well known ecological concerns relating to formaldehyde.

It has long been known that N-methylol compounds are effective stabilizing agents which can be employed as alternatives to formaldehyde (see, for example, U.S. Pat. No. 2,579,435). Such compounds are not subject to the same ecological concerns as formaldehyde, and therefore their use in photographic processing would be highly advantageous. However, the use of N-methylol compounds as stabilizing agents has been considered impractical heretofore, since such compounds tend to undergo polymerization during the stabilization step, with resultant build-up of a scum of polymerized material on the photographic element and on processing equipment, such as, for example, the rollers of the apparatus used in drying the element.

It is toward the objective of providing a stabilization process which renders feasible the use of N-methylol compounds on a commercial basis that the present invention is directed.

SUMMARY OF THE INVENTION

In accordance with this invention, it has been discovered that a wash step can be used, subsequent to effecting stabilization of a photographic color element with an N-methylol compound and prior to drying, to remove polymerized N-methylol compound and thereby prevent the undesired build-up of scum. Such use of a wash step subsequent to a stabilization step is highly unusual in the photographic processing art, since a stabilization step is ordinarily the final step of a process prior to drying. In order to use such a wash step, without its negating the desired stabilization, it has been found to be necessary to appropriately control the time, temperature and pH of the stabilization step to bring about sufficient reaction between the coupler and the N-methylol compound to stabilize the magenta dye image in the stabilization step rather than in the subsequent drying step.

Thus, the present invention provides a novel process for stabilizing the magenta dye image in a photographic color element which comprises the steps of contacting the element with an aqueous stabilizing solution containing a water-soluble N-methylol compound and an akaline buffering agent, subjecting the stabilized element to an aqueous wash to remove scum formed by the treatment with the stabilizing solution, and drying the element at an elevated temperature.

DESCRIPTION OF THE PREFERRED EMBODIMENTS

Figure 2:
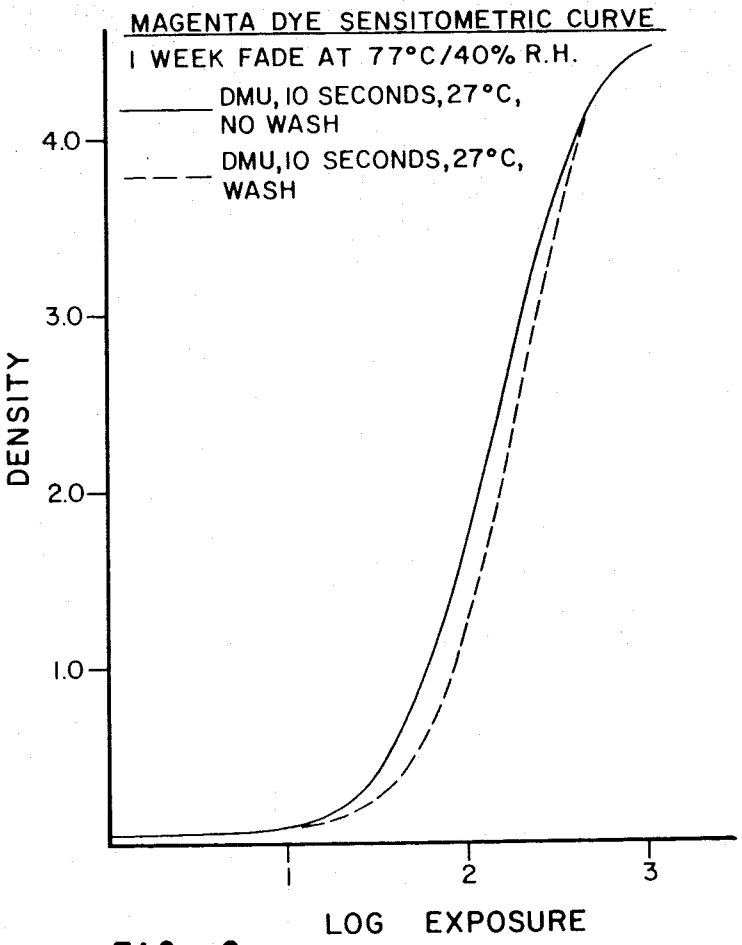

The stabilizing composition of this invention can be used to provide improved dye stability with any of a wide variety of color photographic elements. Thus, for example, the stabilizing composition can be advantageously employed in the processing of photographic elements designed for reversal color processing or in the processing of negative color elements or color print materials. The stabilizing composition can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

Typical examples of photographic elements with which the stabilizing composition of this invention can be advantageously utilized are those described in Research Disclosure, Item 17643, Vol. 176, December, 1978, published by Industrial Opportunities Ltd., Homewell, Havant Hempshire, P09 1EF, United Kingdom. The stabilizing composition is especially beneficial for use with color negative films and reflection print materials, such as prints having a resin-coated paper support.

The photographic elements which are advantageously treated with the stabilizing composition of this invention are elements comprising a support having thereon at least one, and typically three or more, hydrophilic colloid layers containing a dye image. Any of a wide variety of colloids can be utilized in the production of such elements. Illustrative examples of such colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like.

Processes employing the stabilizing composition of this invention can vary widely in regard to the particular processing steps utilized. For example, the process can comprise only the two steps of color developing and bleach-fixing, followed by the stabilizing step, or it can comprise the three steps of color developing, bleaching, and fixing, followed by the stabilizing step. Alternatively, it can be a color reversal process in which the processing baths utilized are a first developer, a reversal bath, a color developer, a bleach, and a fix, followed by the stabilizing bath.

As explained hereinabove, the stabilizing compositions utilized in the process of this invention comprise a water-soluble N-methylol compound and an alkaline buffering agent.

As used herein, the term "N-methylol compound" refers to a compound having at least one methylol group attached directly to a nitrogen atom. Particularly preferred for the purpose of this invention are N-methylol compounds represented by formulae I, II or III as follows:

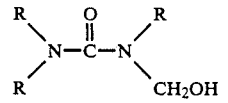
I.

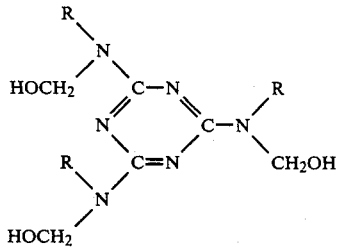
II.

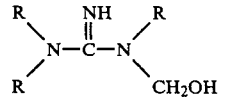
III.

wherein R is a hydrogen atom or a methylol group.

Illustrative examples of particularly preferred N-methylol compounds for the purpose of this invention include:

dimethylol urea (DMU)
trimethylol urea
dimethylol guanidine
trimethyol melamine
tetramethylol melamine
pentamethylol melamine
hexamethylol melamine and the like.

Yet another particularly preferred N-methylol compound is 1,3-dimethylol-5,5-dimethyl hydantoin.

An alkaline buffering agent is incorporated in the stabilizing solution to maintain an alkaline pH. Preferably, the alkaline buffering agent is employed in an amount sufficient to maintain a pH of at least 9, and more preferably at least 10. Useful alkaline buffering agents include hydroxides such as sodium hydroxide or potassium hydroxide, borates such as sodium metaborate, phosphates such as trisodium phosphate, and carbonates such as sodium carbonate or potassium carbonate.

The ingredients utilized in making up the stabilizing composition of this invention can be used in any suitable amount, and the optimum amount of each will vary widely depending on a number of factors such as the particular compounds employed, the manner of treating the photographic element with the stabilizing composition, and the particular type of photographic element which is to be treated. Typically the N-methylol compound is used in an amount of from about 3 to about 90 grams per liter of stabilizing solution, and more preferably in an amount of from about 5 to about 15 grams per liter, and the alkaline buffering agent is used in an amount of from about 1 to about 20 grams per liter of stabilizing solution, and more preferably in an amount of from about 2 to about 10 grams per liter.

Application of the stabilizing composition to a photographic element is conveniently accomplished by immersion of the element in the stabilizing bath, but can be carried out by other means such as surface application. The time and temperature employed for the stabilization treatment can vary widely. For example, suitable times are typically in the range of from about 5 seconds to about 15 minutes, more preferably from about 0.5 to about 3 minutes, while suitable temperatures are typically in the range of from about 20° to about 60° C., and preferably are at least about 35° C. While the stabilizing composition described herein will most typically be used as the final step in a photographic processing cycle, it can also be used as a post-processing treatment. For example, it can be used to treat processed elements in which the dye images have already begun to deteriorate, in order to avoid further deterioration.

Various additives can be incorporated in the stabilizing bath with beneficial results. For example, a wetting agent can be included in the stabilizing composition to protect against the formation of spots during the drying step.

In the process of this invention, control of time, temperature and pH in the manner indicated above enables the stabilizing action to occur in the stabilizing bath rather than in the drying step, and thereby permits removal of scum by a wash without negating the effectiveness of the stabilization step.

The wash step employed in the process of this invention is merely the simple step of washing with water. If desired, a small amount of a suitable acid, such as acetic acid, can be added to the wash water to promote washing. Typically, washing is carried out at a temperature in the range of from about 20° C. to about 40° C. for a period of from about 10 seconds to about 6 minutes.

After completion of the washing step, the photographic element is dried, utilizing conventional drying equipment such as an oven. Typically, drying is carried out at a temperature in the range of from about 20° C. to about 45° C. for a period of from about 10 to about 20 minutes.

The invention is further illustrated by the following examples of its practice. In these examples, the term "formalin" refers to a 30% by weight aqueous solution of formaldehyde.

EXAMPLES 1-6

A motion picture color print film was processed in conventional color developing, bleaching, and fixing baths. Strips of the processed film were treated with a stabilizing bath having a composition as hereinafter described, then washed for 10 seconds with dilute acetic acid solution (5 mL/L) and dried. Each strip was extracted with N,N-dimethylformamide to remove unreacted magenta-dye-forming coupler, and the extract was analyzed by high performance liquid chromatography.

Conditions utilized in the stabilization step for each test are summarized as follows:

| Example No. | Stabilization Bath | Temperature (°C.) | Time (seconds) | pH |
|---|---|---|---|---|
| 1-A | 15 mL/L formalin | 27 | 10 | 5 |
| 1-B | 15 mL/L formalin | 27 | 100 | 5 |
| 1-C | 15 mL/L formalin | 27 | 1000 | 5 |
| 2-A | 15 mL/L formalin | 49 | 10 | 5 |
| 2-B | 15 mL/L formalin | 49 | 100 | 5 |
| 2-C | 15 mL/L formalin | 49 | 1000 | 5 |
| 3-A | 15 mL/L formalin + 10 g/L $K_2CO_3$ | 49 | 10 | 10.4 |
| 3-B | 15 mL/L formalin + 10 g/L $K_2CO_3$ | 49 | 100 | 10.4 |
| 3-C | 15 mL/L formalin + 10 g/L $K_2CO_3$ | 49 | 1000 | 10.4 |
| 4-A | 13 g/L DMU | 49 | 10 | 7.5 |
| 4-B | 13 g/L DMU | 49 | 100 | 7.5 |
| 4-C | 13 g/L DMU | 49 | 1000 | 7.5 |
| 5-A | 13 g/L DMU + 10 g/L $K_2CO_3$ | 27 | 10 | 10.4 |
| 5-B | 13 g/L DMU + 10 g/L $K_2CO_3$ | 27 | 100 | 10.4 |
| 5-C | 13 g/L DMU + 10 g/L $K_2CO_3$ | 27 | 1000 | 10.4 |
| 6-A | 13 g/L DMU + 10 g/L $K_2CO_3$ | 49 | 100 | 10.4 |
| 6-B | 13 g/L DMU + 10 g/L $K_2CO_3$ | 49 | 100 | 10.4 |
| 6-C | 13 g/L DMU + 10 g/L $K_2CO_3$ | 49 | 1000 | 10.4 |

The results obtained from the chromatographic analysis are summarized in Table I below:

TABLE I

| Example No. | Stabilization Time (seconds) 10 | 100 | 1000 |
|---|---|---|---|
| 1 | ++ | ++ | + |
| 2 | + | 0 | 0 |
| 3 | + | 0 | 0 |
| 4 | ++ | ++ | ++ |
| 5 | + | 0 | 0 |
| 6 | 0 | 0 | 0 |

++=large amount of magenta coupler detected
+=small amount of magenta coupler detected
0=no magenta coupler detected As indicated by the data reported in Table I, use of dimethylol urea (DMU) in a stabilizing bath that contains the alkaline buffering agent potassium carbonate ($K_2CO_3$) gives just as good results in terms of eliminating excess magenta-dye-forming coupler as does the use of formaldehyde. In addition, the use of dimethylol urea is highly advantageous in that it is not subject to the ecological disadvantages associated with the use of formaldehyde.

EXAMPLES 7-8

A motion picture color print film was processed and evaluated in the same manner as in the examples above, except that the stabilizing conditions were as follows:

| Example No. | Stabilization Bath | Temperature (°C.) | Time (seconds) | pH |
|---|---|---|---|---|
| 7-A | 13 g/L DMU + 10 g/L $K_2CO_3$ | 27 | 10 | 10.4 |
| 7-B | 13 g/L DMU + 10 g/L $K_2CO_3$ | 27 | 20 | 10.4 |
| 7-C | 13 g/L DMU + 10 g/L $K_2CO_3$ | 27 | 30 | 10.4 |
| 7-D | 13 g/L DMU + 10 g/L $K_2CO_3$ | 27 | 40 | 10.4 |
| 7-E | 13 g/L DMU + 10 g/L $K_2CO_3$ | 27 | 50 | 10.4 |
| 7-F | 13 g/L DMU + 10 g/L $K_2CO_3$ | 27 | 60 | 10.4 |
| 7-G | 13 g/L DMU + 10 g/L $K_2CO_3$ | 27 | 120 | 10.4 |
| 8-A | 13 g/L DMU + 10 g/L $K_2CO_3$ | 49 | 10 | 10.4 |
| 8-B | 13 g/L DMU + 10 g/L $K_2CO_3$ | 49 | 20 | 10.4 |
| 8-C | 13 g/L DMU + 10 g/L $K_2CO_3$ | 49 | 30 | 10.4 |
| 8-D | 13 g/L DMU + 10 g/L $K_2CO_3$ | 49 | 40 | 10.4 |
| 8-E | 13 g/L DMU + 10 g/L $K_2CO_3$ | 49 | 50 | 10.4 |
| 8-F | 13 g/L DMU + 10 g/L $K_2CO_3$ | 49 | 60 | 10.4 |
| 8-G | 13 g/L DMU + 10 g/L $K_2CO_3$ | 49 | 120 | 10.4 |

The results obtained from the chromatographic analysis are summarized in Table II below:

TABLE II

| Example No. | Stabilization Time (seconds) 10 | 20 | 30 | 40 | 50 | 60 | 120 |
|---|---|---|---|---|---|---|---|
| 7 | ++ | + | 0 | + | + | 0 | + |
| 8 | 0 | 0 | 0 | 0 | 0 | 0 | 0 |

As indicated by the data reported in Table II, use of dimethylol urea (DMU) in a stabilizing bath that contains the alkaline buffering agent potassium carbonate ($K_2CO_3$) gives excellent results at 49° C. in a time as short as 10 seconds.

Figure 1:
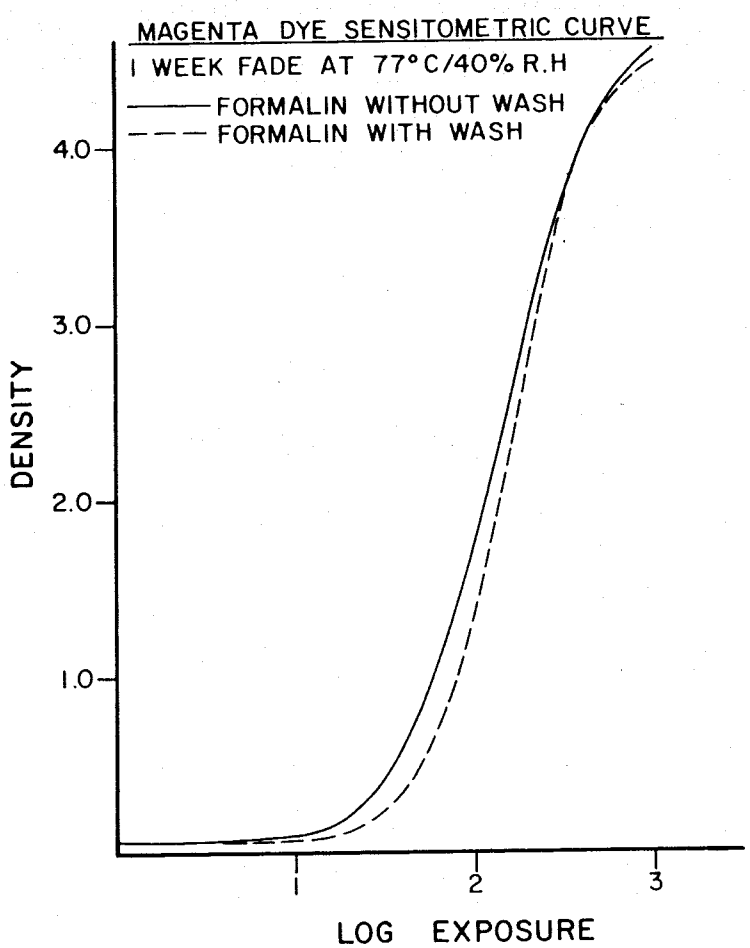
Figure 3:
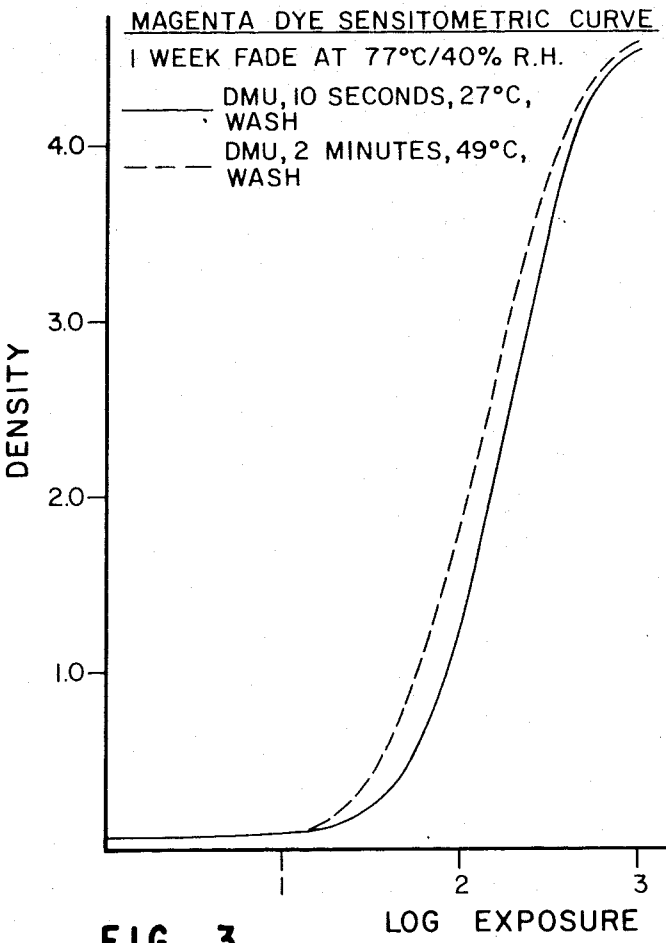
Figure 4:
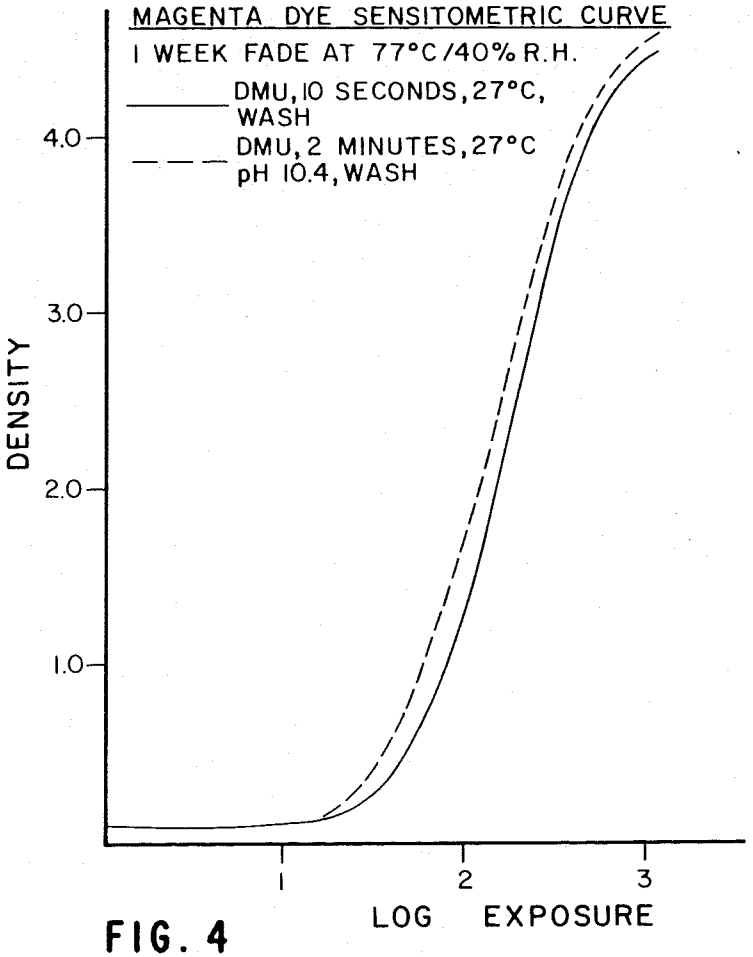
Figure 5:
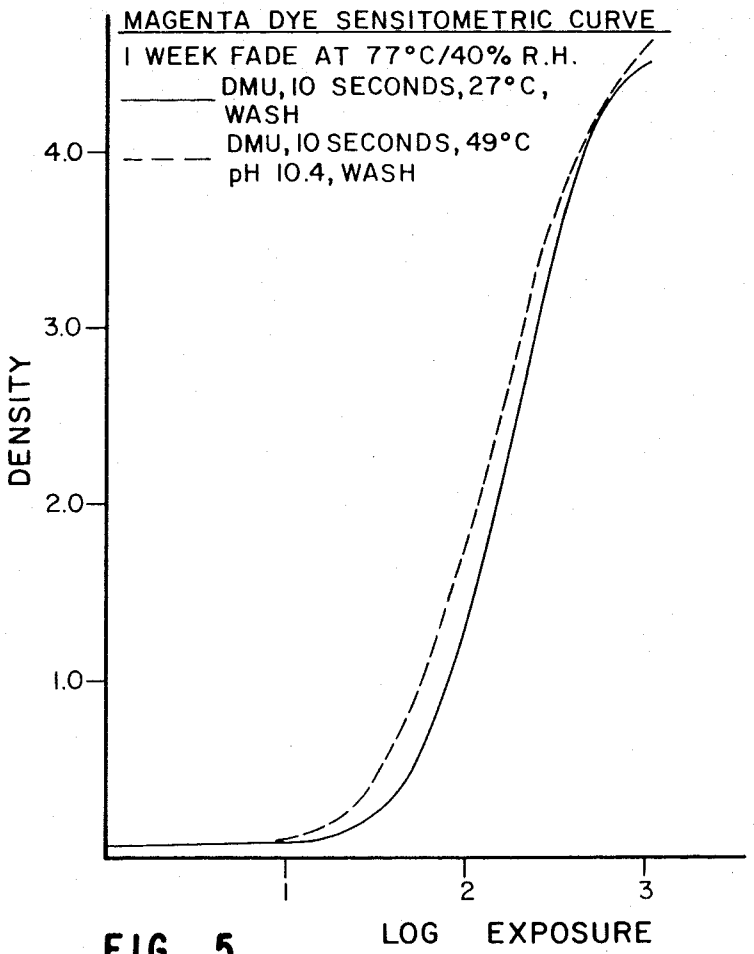

The results of photographic tests are summarized in FIGS. 1 to 5 attached hereto. Each of these figures illustrates the magenta dye sensitometric curve. The plots represent data obtained after one week in a standard dark fading procedure at 77° C. and 40% relative humidity. FIG. 1, which corresponds to the conditions of Example 1, indicates that use of a wash after treatment with a stabilizing bath containing formaldehyde gives a similar dye loss to film processed without a stabilizing bath. FIG. 2 indicates that use of a wash will negate the stabilization achieved with dimethylol urea when low temperature and low pH conditions are employed. FIG. 3 indicates that use of a wash will not negate stabilization achieved with dimethylol urea when high temperatures and adequate stabilization times are used. FIG. 4 indicates that use of a wash will not negate stabilization achieved with dimethylol urea when high pH and adequate stabilization times are used. FIG. 5 indicates that effective stabilization is achieved in only 10 seconds by use of dimethylol urea when both high pH and high temperature conditions are employed.

The invention has been described in detail with particular reference to preferred embodiments thereof, but it will be understood that variations and modifications can be effected within the spirit and scope of the invention.

I claim:

1. A process for stabilizing the magenta dye image in a photographic color element comprising a support having thereon at least one hydrophilic colloid layer containing a magenta dye image formed by coupling of oxidized developing agent with magenta-dye-forming coupler, said process comprising the steps of:

(1) contacting said element for a period of at least about 5 seconds at a temperature of at least about 20° C. with an aqueous stabilizing solution consisting essentially of a water-soluble N-methylol compound and a sufficient amount of an alkaline buffering agent to provide a pH of at least 9, (2) subjecting said element to an aqueous wash to remove scum formed in step (1), and (3) drying said element at an elevated temperature.

2. A process as claimed in claim 1 wherein said N-methylol compound is defined by one of the following formulae I, II, or III:

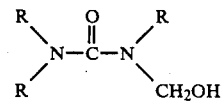

I.

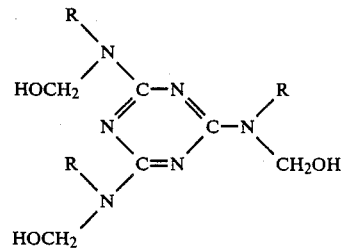

II.

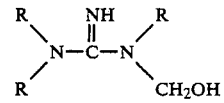

III.

where R is a hydrogen atom or a methylol group.

3. A process as claimed in claim 1 wherein said N-methylol compound is selected from the group consisting of dimethylol urea, trimethylol urea, dimethylol guanidine, trimethylol melamine, tetramethylol melamine, pentamethylol melamine and hexamethylol melamine.

4. A process as claimed in claim 1 wherein said N-methylol compound is dimethylol urea.

5. A process as claimed in claim 1 wherein said N-methylol compound is 1,3-dimethlol-5,5-dimethyl hydantoin.

6. A process as claimed in claim 1 wherein said alkaline buffering agent is selected from the group consisting of hydroxides, borates, phosphates and carbonates.

7. A process as claimed in claim 1 wherein said alkaline buffering agent is potassium carbonate.

8. A process as claimed in claim 1 wherein said N-methylol compound is present in said stabilizing solution in an amount of at least about 3 grams per liter.

9. A process as claimed in claim 1 wherein contact in step (1) is at a temperature of at least about 35° C.

10. A process for stabilizing the magenta dye image in a photographic color element comprising a support having thereon at least one hydrophilic colloid layer containing a magenta dye image formed by coupling of oxidized developing agent with magenta-dye-forming coupler, said process comprising the steps of:

(1) contacting said element for a period of at least about 10 seconds at a temperature of at least about 35° C. with an aqueous stabilizing solution consisting essentially of dimethylol urea and a sufficient amount of an alkaline buffering agent to provide a pH of at least about 10, (2) subjecting said element to an aqueous wash to remove scum formed in step (1), and (3) drying said element at an elevated temperature.

* * * * *